United States Patent [19]

Desnoulez et al.

[11] 4,393,733

[45] Jul. 19, 1983

[54] CORKSCREWS WITH TACKLE REDUCTION

[76] Inventors: Bruno Desnoulez, 76, Boulevard du Général Koenig, 92200 Neuilly; André Dejoux, 15, rue Lakanal, 75015 Paris, both of France

[21] Appl. No.: 174,655

[22] Filed: Aug. 1, 1980

[30] Foreign Application Priority Data

Aug. 2, 1979 [FR] France ..... 79 19823
Jul. 4, 1980 [FR] France ..... 80 14994

[51] Int. Cl.[3] ..... B67B 7/00
[52] U.S. Cl. ..... 81/3.38 A
[58] Field of Search ..... 81/3.34, 3.35, 3.36, 81/3.37, 3.38 R, 3.38 A

[56] References Cited

U.S. PATENT DOCUMENTS 2,522,219 9/1950 Gaeta ..... 81/3.38 A

FOREIGN PATENT DOCUMENTS 33837 2/1908 Austria ..... 81/3.38 R
1589350 4/1970 France ..... 81/3.38 A

*Primary Examiner*—James G. Smith
*Attorney, Agent, or Firm*—Browdy and Neimark

[57] ABSTRACT

A corkscrew is provided with tackle reduction by a tackle engaged in a tubular body flared at its base. In a first tube, slide telescopic extension tubes are fitted onto one another and thrust elastically by a stirrup or the like with two recall springs on a shoulder of the main tube which has a shoulder near its other end. The outside telescopic tube receives a maneuvering handle or similar. The telescopic tubes are immobilized in relation to one another in rotation by means of stamped longitudinal grooves, reduction is assured by two tackle-blocks. The maneuvering handle is made by molding in a single piece; it is centered on the upper end of the outside tube and immobilized in rotation by the maneuvering arms of the handle engaged in the corresponding grooves and fastened by gluing or crimping. The upper tackle-block is fastened both on a washer and the upper shoulder of the main tube by a blind rivet or the like and the lower tackle-block is welded or crimped on the screw-carrying plate.

7 Claims, 14 Drawing Figures

FIG.9
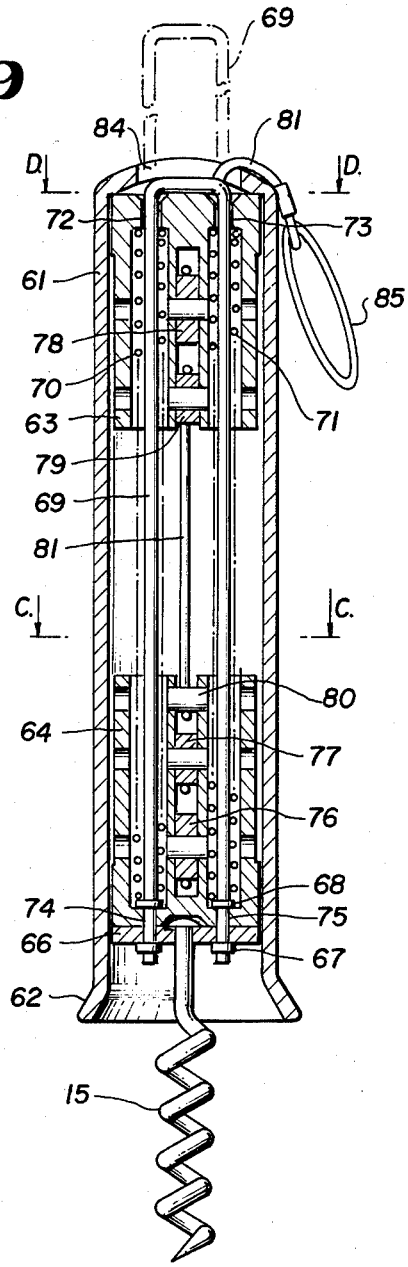
FIG.10
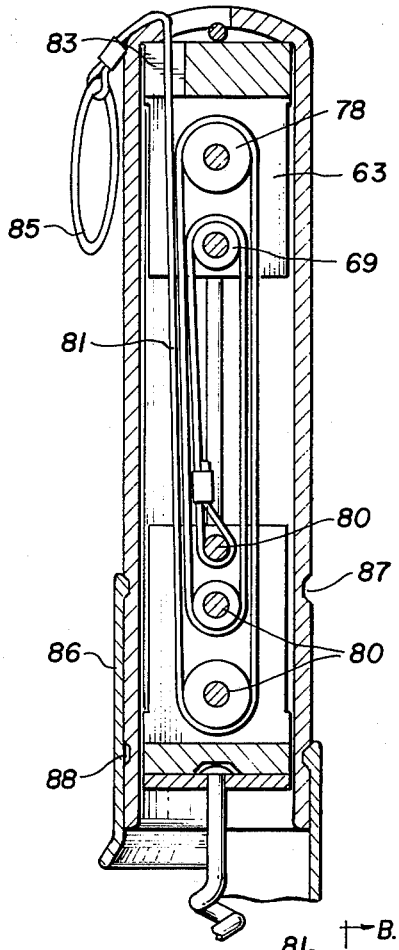
FIG.11
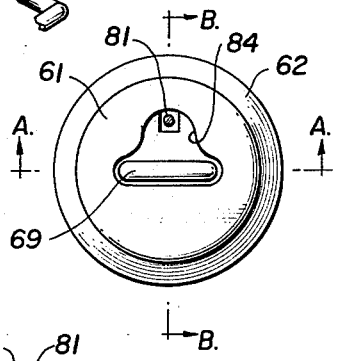
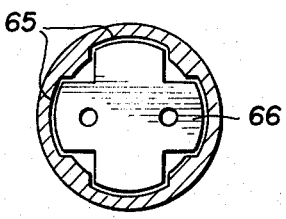
FIG.12
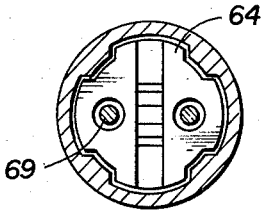
FIG.13
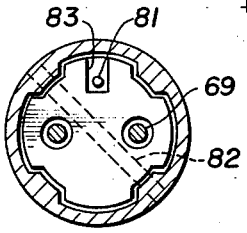
FIG.14

CORKSCREWS WITH TACKLE REDUCTION

BACKGROUND OF THE INVENTION

This invention relates to corkscrews equipped with means making it possible to reduce in considerable proportion the effort and time required for removing corks from bottles and similar containers.

A tackle reduction corkscrew described in French Pat. No. 1,589,350 and in German (FRG) Pat. No. 204,020 is already known. The embodiment of these corkscrews is complicated and onerous; moreover, they generate friction that cause a part of the gain in the reduction of the removal effort to be lost.

SUMMARY OF THE INVENTION

The object of the present invention is to provide corkscrews which mitigate the above-mentioned various drawbacks, while offering a very simple and very fast use.

The invention, as characterized in the claims, solves the problem by providing a corkscrew with a reduction tackle which is very simple to make and assemble, made in three versions of increasing simplicity.

The first version according to the invention simplifies the corkscrew described in the above-mentioned French patent, paarticularly the design of the maneuvering handle and the assembly.

The second version differs from the first in that the stirrup receiving the recall springs is a single central rod and not U-shaped, also the design of the tackle blocks is simpler and the maneuvering cable is much easier to put in place. In these two versions, the lower tackle-block moves over a path equal to that of the extraction, while the upper-tackle block is stationary. The maneuvering handle, solid with the outside telescopic tube, moves with it, pulling the traction belt of the lower tackle-block.

The third version is even simpler than the two preceding ones in that the telescopic tubes are replaced by a tubular body in whose bottom the upper tackle-block is fastened and remains immobile. Only the lower tackle-block moves during removal to come, at the finish of the cork extraction, to strike against the upper tackle-block under the action of traction on a flexible cord that is wound on the two tackle-blocks and comes out of the tubular body at its upper end. The tackle-blocks and tubular body are made of molded plastic, which eliminates a number of machinings and reduces assembly time to almost nothing.

The resulting advantages, thanks to this invention, lies essentially in the fabrication and assembly being greatly simplified, friction being cut drastically and, for the same reduction, less traction effort; further, the screw is automatically centered on the cork to be removed.

BRIEF DESCRIPTION OF THE DRAWINGS

Other characteristics and advantages of this invention are to be better understood from reading the following description, with reference made to the accompanying drawings, in which:

FIGS. 9 and 10 show the section of a corkscrew according to a third version, seen in elevation along A and B of the top view of FIG. 11;

FIG. 11 shows a top view according to FIG. 9;

FIG. 12 shows the screw-carrying plate and its guiding by the grooves of the tubular body;

FIG. 13 is a section along C of FIG. 9 showing the lower tackle-block in a top view and its guiding in the tubular body;

FIG. 14 is a section of the tubular body along D of FIG. 9 showing the upper tackle-block in a top view.

DETAILED DESCRIPTION OF THE PREFERRED EMBODIMENTS

Figure 1:
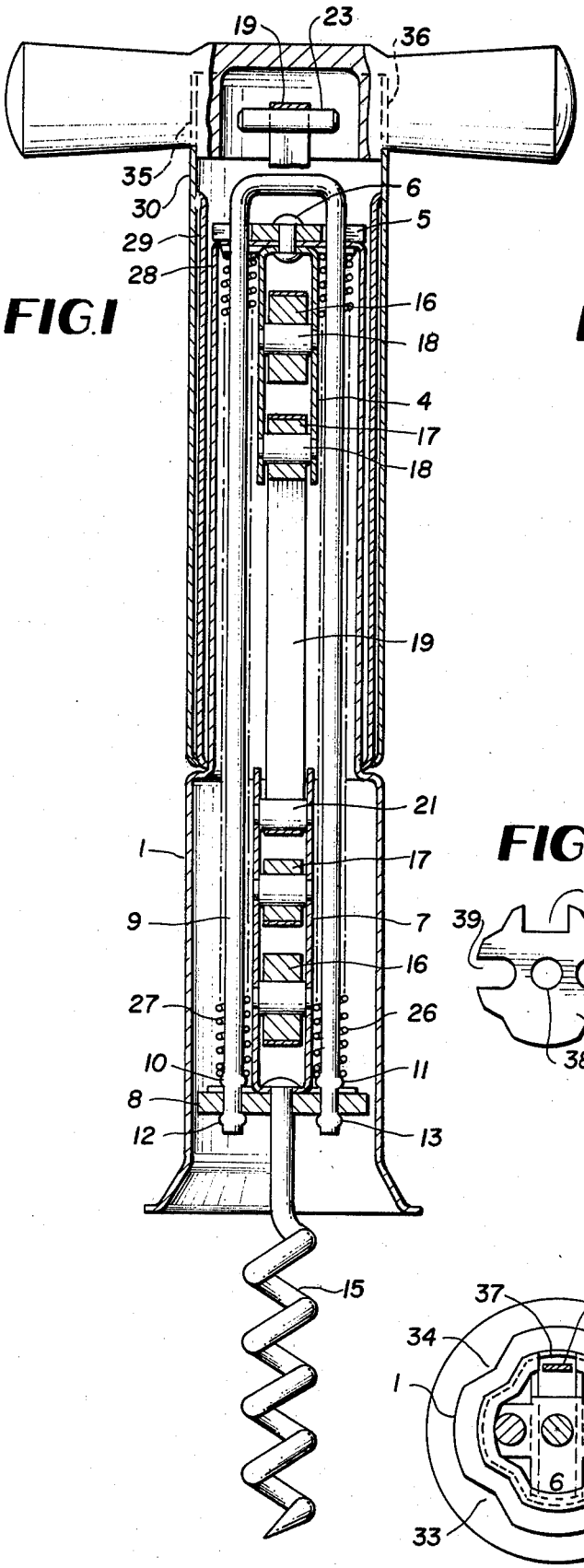
FIGS. 1 and 2 show, in sections along two perpendicular planes, an example of a corkscrew according to the invention.
Figure 2:
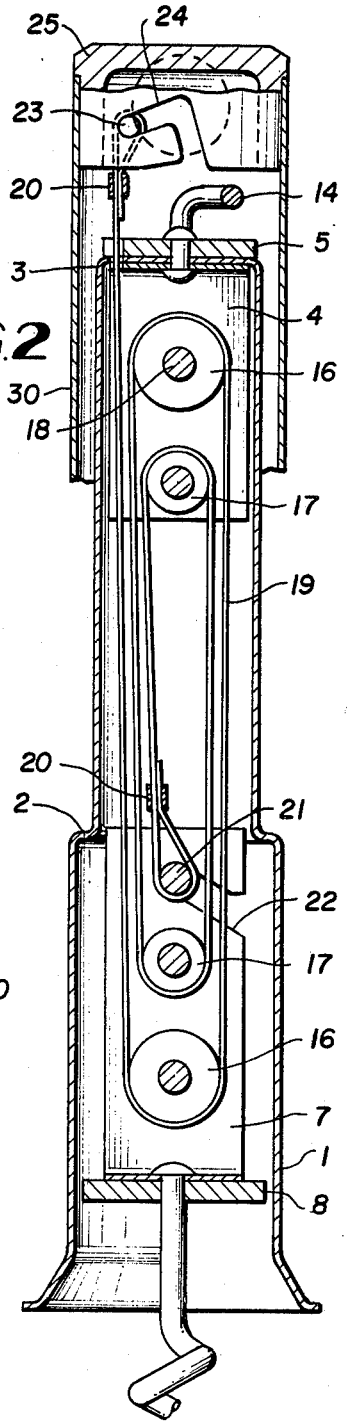

The first embodiment shown in FIGS. 1–4 includes a main tube 1 flared at its base to act as a guide and support on the neck of the bottles to be uncorked. This tube is shouldered at 2 to form an extractor travel stop. The second part of the tube also has a shoulder 3 that acts as an internal support for the body of upper tackle-block 4 fastened to the shoulder 3 by a washer 5 by and a rivet 6 or any other known techniques. A second tackle-block 7 is placed at the base, fastened on guide plate 8 by crimpings 10, 11, 12, 13 of the lower part of metal rods of stirrup 9 bent in the shape of a U and counterbent in its upper part 14 to permit placement of the rivet 6. Guide plate or screwcarrying plate 8 receivess, by crimping or welding corkscrew 15. Each of tackle-blocks 4 and 7 includes two flat pulleys 16 and 17; inner pulleys 17 have a smaller diameter to assure passage of the maneuvering belt to the second stage of pulleys 16. The pulleys turn 16, 17 on shouldered shafts 18 which are crimped on the tackle-block bodies made of bent sheet metal. Belt 19, of a very thin metal or of flexible plastic of slight elongation under load, includes, at each of its ends, a loop obtained by gluing or pinching with a crimped metal fastener 20, or else by welding for the metal belt. The lower loop is slipped on shouldered shaft 21, which is engaged in groove 22 formed in the lower tackle-block 7. The upper loop is slipped in the same way on shaft 23 engaged in groove 24 of maneuvering handle 25. The handle is made by molding. The tackle-blocks 7, 8 are elastically recalled to rest position by two compression recall springs 26, 27 slipped on branches 9 of the guide stirrup 9 of the lower tackle-block 7.

The upper part of the stirrup 9 is guided in washer 5. Three telescopic extension tubes 28, 29, 30 slide on one another to keep handle 25 in the axis of main tube 1 during extraction of the cork. They are flared at their upper end and narrowed at the base to prevent their jumping out during sliding. To allow screwing of screw 15 in corks by handle 25, the various tubes have received four longitudinal stampings 31, 32, 33, 34 (FIG. 3) avoiding drilling of the tubes. Washer 8 has clearances corresponding to the grooves stamped in body 1 to be immobilized in rotation. Handle 25 is fixed in the free end of outside tube 30, its two rods are engaged in two opposite grooves 35, 36 of tube 30 to assure driving in rotation. The handle is either glued on tube 30 or else tube 30 is crimped on the handle to be able to pull upward without a risk of coming off. When handle 25 is pulled, a traction is exerted on the belt, the tubes slide on one another and the corkscrew 15 is drawn into body, from its extended position and, screw-carrying washer 8 goes into body 1 until it strikes shoulder 2 at the end of the extraction of the cork. The handle 25 is then released and the recall springs 26, 27 bring the lower tackle-block 7 into position for a new extraction. Outside extension tube 30, under the action of springs 26, 27 is against the shoulder of tube 1. Reduction obtained by the tackle is a function of the number of stages of pulleys and of their diameter.

Figure 3:
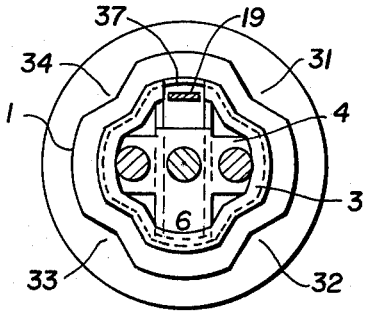
FIG. 3 shows a top view of the corkscrew, with the maneuvering handle and fastening washer removed.

FIG. 3 shows a top view of the corkscrew, with the handle and extension tubes removed. There can be seen clearance 37 made on upper tackle-block 4 and shoulder 3 of main tube 1 to assure passage of the belt to shaft 23 of handle 25 and also the shape of the longitudinal stampings 31–34 which transmit the rotating torque of the handle to the screw.

Figure 4:
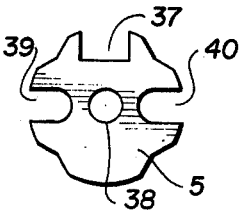
FIG. 4 shows the shape of the fastening washer.

FIG. 4 shows, in a top view, washer 5 assuring, in cooperation with blind rivet 6 (FIG. 1), fastening of upper tackle-block 4 on shoulder 3 of body 1, hole 38 for passage of blind rivet 6 and grooves 39 and 40 for passage of stirrup 9.

Figure 5:
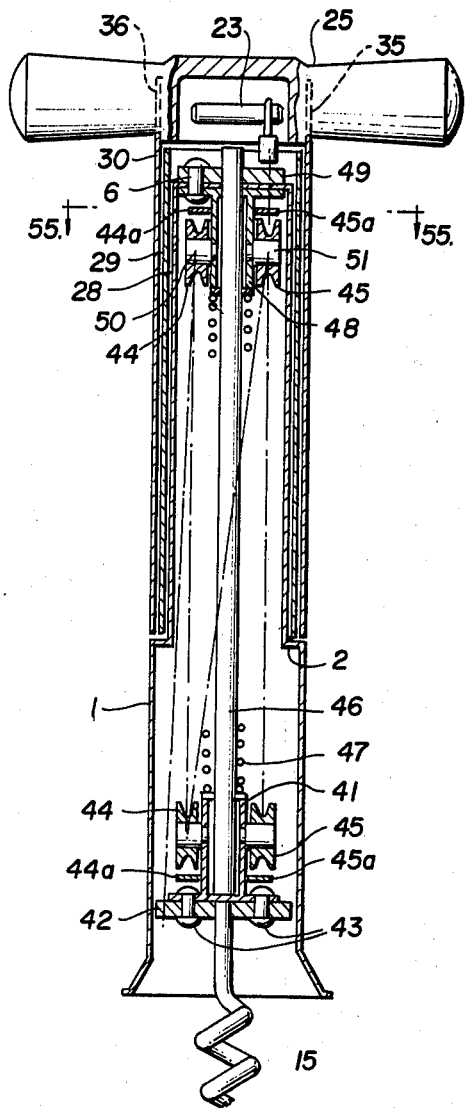
FIGS. 5 and 6 show a variant in the design of the reduction tackle.
Figure 6:
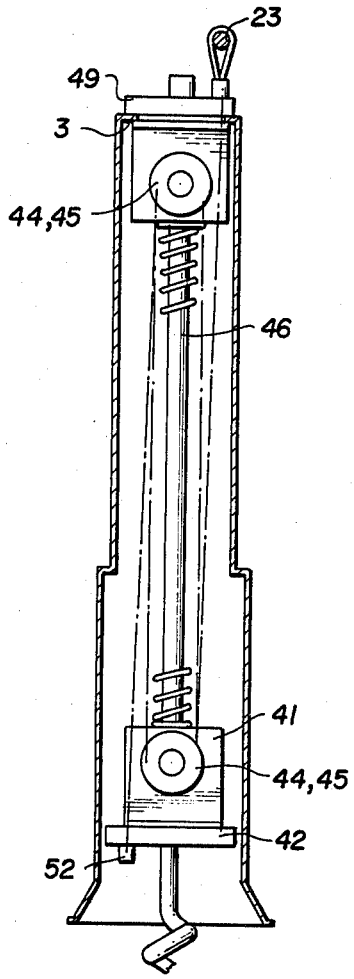
Figure 7:
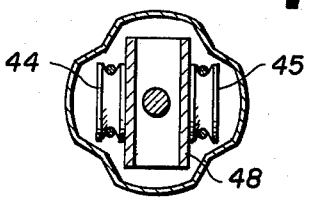
FIGS. 7 shows the shape of the upper tackle, with the fastening washer removed.

FIGS. 5–7 show a second version of the corkscrew placed in the same telescopic tubular unit. In contrast, the design of the tackle is different. It includes a lower tackle-block 41 of bent sheet metal, made solid with the screw-carrying plate 42 by two rivets 43. Tackle-block 41 forms a shell on which are mounted, overhanging on each side, pulleys with identical grooves 44, 45. The stirrup is replaced by a central guide rod 46 carrying recall spring 47 intended to bring the screw-carrying plate 42 into rest position. Guide rod 46 goes through upper tackle-block 48, identical with the lower tackle-block 41, and is engaged in the central hole of washer 49 for fastening the upper tackle-block on end 3 of tube 1 by one or more blind rivets 6 as in the first version. Pulleys 44, 45 are mounted to turn freely on shafts 50, 51 crimped on the shell. The belt is replaced by a flexible cable which can be of stranded steel or plastic of the fishing line type or braided cord with great resistance to elongation. The lower part is engaged in washer 42 fixed by protuburance 52 obtained by overmolding or a crimped fastener or any other known techniques. It is then wound on pulley 44 of the upper tackle-block, comes back over pulley 44 of the lower tackle-block then goes up over pulley 45 of the upper tackle-block 48, goes down over pulley 45 of the lower tackle-block and goes up to hook on handle 25. Hooking is done on shaft 23 or in a slot molded in handle 25. Guide shaft 46 can be immobilized at the level of the lower housing. Functioning is identical with that of the first version. To keep the cable from leaving the pulley at the time of elastic return to rest position, pins 44*a* and 45*a* have been provided at right angles to each pulley.

Figure 8:
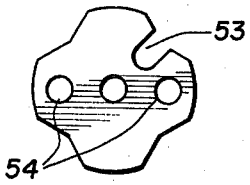
FIG. 8 shows the shape of the fastening washer of the upper tackle-block.

FIG. 8 shows the shape of washer 49 for fastening the upper bearing on the shoulder of tube 1. Slot 53 allows passage of the cable to its hooking point on shaft 23. Holes 54 receive blind rivets 6 assuring immobilization on tube 1.

FIG. 7 is a section along arrow 55 (FIG. 5) showing the arrangement of the upper tackle-block 48 in the narrowed part of tube 1 and the placement of pulleys 44, 45.

As shown in section in FIG. 9, the third version of the corkscrew according to the invention includes a tubular body 61 which can be provided on the outside with means such as polygonal faces, longitudinal grooves or other, to assure a good manual holding of the tube for screwing because it is not necessary to use a handle, as in the previous versions, since it is not necessary to pull on a telescopic tube. Lower part 62 is flared for centering on the upper part on the neck of the bottles for screwing. The telescopic tubes have been eliminated. Internal friction therefore is extremely reduced. The tackle-block arrangement has also been simplified. In includes upper tackle-block 63 and lower tackle-block 64, both made of plastic molded by injection. The tubular body can be molded from light metal or plastic. All machining has been eliminated except screw-carrying plate 66 and the pulley shafts.

Tubular body 61 comprises four grooves 65 serving to guide and prevent rotation of lower tackle-block 64 and of plate 66 carrying screw 67 that is crimped or welded. Lower tackle-block 64 is fastened to the screw-carrying plate 66 by crimpings 67, 68 of stirrup 69 made during assembly of the tackle-blocks.

Stirrup 69 acts as a guide for recall springs 70, 71. It goes through the upper tackle-block by holes 72, 73, and the lower tackle-block by holes 74, 75, these holes are spotfaced on the greater part of their length to assure support and passage of recall springs 70, 71. As a variant, the pitch between the rods and stirrup 69 can be increased to leave only the base and a shell to hold pulley shafts 76, 77 and 78, 79 of the tackle-blocks and shaft 80 intended for hooking of cord 81 on the lower tackle-block.

Shafts 80 can be free in their housing because they are held in place by springs 70, 71. It is also possible to leave them free in their housing, but fit them slightly hard in the pulleys or vice versa.

Crimpings 68 are made after placing of the stirrup in tackle-block 63 and of springs 70, 71. Tackle-block 64 and plate 66 are firstly placed and then crimping 67 is performed. The tackle unit is then engaged in body 61. Upper tackle-block 63 is thrust against the bottom of tubular body 61 and is immobilized by a pin 82 going through body 61 and tackle-block 63. The tackle-block 63 can also be glued.

FIG. 10 shows in section along B of FIG. 11 the arrangement of the tackle. Cord 81, hooked onto shaft 80, passes successively over pulleys 79, 77, 78, 76 and leaves tubular body 61 by groove 83 (FIG. 14) and by hole 84 (FIG. 11) to hang along body 61 under the weight of ring 84 on which it is fastened.

FIG. 10 shows, as a variant of FIG. 9, a sleeve 86, of molded plastic, sliding on the lower end of body 61 and able to slip elastically in grooves 87, 88 of body 61. This sleeve has the function of centering the corkscrew on the bottle. Before the corkscrew is put into place, sleeve 86 is shoved downward until it slides elastically into groove 88 of the body. The flared part of the sleeve is then placed on the upper part of the neck of the bottle, then a thrust is exerted on the upper end of the tubular body, the sleeve slides out and rises slightly until the tip of the screw touches the cork on which it is then centered. All that remains is to screw the screw until the lower end of the tubular body rests on the upper part of the bottle, sleeve 86 is then raised up entirely on body 61 and slides into groove 87. All that remains is to pull on ring 85 to remove the cork. The lower tackle-block rises in body 61 until it comes to strike on upper tackle-block 63 at the end of extraction while stirrup 69 has come out of body 61 through hole 84 (shown in fine dotted lines in FIG. 9). When cord 81 is slackened, recall springs 70,

71 bring lower tackle-block 64 to rest position downward until the upper part of the stirrup rests against the upper part of tackle-block 63.

A metal or plastic fastener can be on the upper part of body 61 to hook the corkscrew on a pocket like a fountain pen.

Assembly of this third version of the corkscrew is extremely fast and easy which clearly differentiates it from the two preceding ones.

We claim:

1. A corkscrew comprising a screw-carrying plate and a tackle arrangement, a one-piece molded generally tubular body, a cork extracting screw fixed to said screw-carrying plate, means to mount said plate and said tackle arrangement inside said body, said body being closed by an end wall at its other upper end, said tackle arrangement comprising upper and lower tackle block means to secure said upper tackle block in said upper end of said body in closely spaced relation to said end wall, said securing means comprising a pin extending through said upper tackle block and the juxtapositioned portions of said body, said one-piece molded body being formed with integral internal groove means extending over substantially all of the internal height of said body, said upper and lower tackle blocks and screw-carrying plate being formed with complementary groove means mating with said body groove means, mating of said body and upper tackle block groove means serving to prevent relative rotation between said upper tackle block and said body, mating of said lower tackle block and said body groove means serving to prevent relative rotation between said lower tackle block and said body and to guide axial motion of said lower tackle block within said body, said upper tackle block serving as a stop for the upward motion of said lower tackle block within said body, a generally "U"-shaped stirrup comprising a pair of generally parallel elongated legs and a cross-connecting portion at one end of said legs, said body end wall being formed with an opening to permit said cross-connecting portion of said stirrup and portions of said legs to extend therethrough and to be located externally of said body, said stirrup cross-connecting portion being adapted to fit through said end wall opening and to engage an upper surface of said upper tackle block to thereby define an end of downward travel stop of said stirrup with respect to said upper tackle block, recall compression spring means mounted on said legs of said stirrup and constrained between said upper and lower tackle blocks to normally urge said upper and lower tackle blocks away from each other; means to secure said screw-carrying plate, said lower tackle block and the free ends of said legs of said stirrup to each other; said securing means comprising a pair of crimped portions on each of said legs which fix said lower tackle block and said screw-carrying plate therebetween, said tackle arrangement comprising cable means, means to secure one end of said cable means to said lower tackle block, said one-piece generally tubular body end wall being formed with opening means permitting said cable means to pass therethrough, the end of said cable means passing through said opening means comprising a free operating end of said tackle arrangement cable means, said molded one-piece tubular body including no external moving parts other than said free operating end of said cable means, and said stirrup legs' length being such with respect to said upper and lower motion stops and with respect to the length of said one-piece molded generally tubular body that said screw-carrying plate and said lower tackle block secured thereto do not extend out of the lower open end of said body during normal use of said corkscrew.

2. A corkscrew according to claim 1, wherein the lower end of said tubular body is provided with a sleeve slidably mounted on its outside surface, said sleeve being formed with an elastic deformation locking means which cooperate with a groove formed in said tubular body, and said locking means also being cooperable with a second groove formed in said tubular body in its lower portion in which position it is adapted to center the corkscrew on the neck of a bottle to be opened.

3. A corkscrew according to claim 1, wherein an outside surface of said tubular body is provided with means for enhancing the grip of a user on said corkscrew to perform screwing of said screw-carrying plate into a cork.

4. The corkscrew of claim 1, wherein said one-piece generally tubular body is formed entirely of injection molded plastic.

5. The corkscrew of claim 1, where said one-piece generally tubular body is formed entirely of metal.

6. The corkscrew of claim 1, wherein the external surface of said molded one-piece generally tubular body is provided with grip enhancing means such as polygonal faces.

7. The corkscrew of claim 1, wherein the external surface of said molded one-piece generally tubular body is provided with grip enhancing means such as longitudinal grooves.

* * * * *